US008740412B2

(12) United States Patent
Rempel

(10) Patent No.: US 8,740,412 B2
(45) Date of Patent: Jun. 3, 2014

(54) COMPOSITE LIGHTING SYSTEMS AND METHODS OF MAKING SAME

(76) Inventor: M. Nicholas Rempel, Seattle, WA (US)

( * ) Notice: Subject to any disclaimer, the term of this patent is extended or adjusted under 35 U.S.C. 154(b) by 247 days.

(21) Appl. No.: 13/445,313

(22) Filed: Apr. 12, 2012

(65) Prior Publication Data

US 2013/0271986 A1 Oct. 17, 2013

(51) Int. Cl.
*F21V 99/00* (2006.01)

(52) U.S. Cl.
USPC ..... 362/254; 362/650; 362/362

(58) Field of Classification Search
USPC ..... 362/254, 650, 362
See application file for complete search history.

(56) References Cited

U.S. PATENT DOCUMENTS

| | | | | |
|---|---|---|---|---|
| 4,507,719 | A * | 3/1985 | Quiogue | 362/404 |
| 5,073,845 | A * | 12/1991 | Aubrey | 362/650 |
| 5,398,179 | A * | 3/1995 | Pacheco | 362/364 |
| 7,461,964 | B1 * | 12/2008 | Aubrey | 362/647 |

* cited by examiner

*Primary Examiner* — Laura Tso
(74) *Attorney, Agent, or Firm* — Emp Exhibits LLC

(57) ABSTRACT

A method for retrofitting a lighting system includes providing a lighting assembly with a screw-terminal-base connector disposed in a lamp housing. A power-supply conductive wire includes a second length coupling the screw-terminal-base connector to a transformer and a first length coupled to the transformer and coupleable to a power supply. The first and second lengths of the power-supply conductive wire are severed and the transformer is removed. The severed first and second lengths are spliced together. An Edison-base receptacle is mounted to the lamp housing. The second length of the power-supply conductive wire is electrically coupled to the Edison-base receptacle.

20 Claims, 7 Drawing Sheets

COMPOSITE LIGHTING SYSTEMS AND METHODS OF MAKING SAME

FIELD

The present invention is directed to the area of lighting systems and methods of making the lighting systems. The present invention is also directed to composite lighting systems retrofitted for receiving lamps with Edison bases, as well as methods of making the composite lighting systems.

BACKGROUND

Lighting systems, including lighting assemblies with lamp housings and lamps, are commonly used for illumination in residential and commercial settings, as well as for various types of transportation-related illumination. The illumination provided by different lighting systems may vary in many different ways including, for example, color, intensity, beam pattern, or the like. One way to vary the illumination provided by a lighting system is to swap an existing lamp with a different type of lamp. Currently, there are many different types of lamps available. The different types of lamps may vary in a variety of different ways including, for example, size, cost, efficiency, shape, style, color of illuminated light, intensity of illuminated light, beam pattern of illuminated light, or the like or combinations thereof.

BRIEF SUMMARY

In one embodiment, a method for retrofitting a lighting system includes providing a lighting assembly. The lighting assembly includes a 120v to 12v transformer disposed at least partially in a transformer housing. A lamp housing is coupled to the transformer housing. The lamp housing is configured and arranged to receive a lamp with a diameter that is no greater than six inches. At least one screw-terminal-base connector is disposed in the lamp housing. The at least one screw-terminal-base connector is configured and arranged to receive a 12v lamp. The lighting assembly also includes at least one power-supply conductive wire. Each of the at least one power-supply conductive wires includes a first length and a second length. Each of the at least one first lengths is coupled at one end to the transformer while an opposing end of each of the at least one first lengths is coupleable to a power supply. Each of the at least one second lengths is coupled at one end to the transformer while an opposing end of each of the at least one second lengths is coupled to the at least one screw-terminal-base connector. Each of the at least one first lengths of the at least one power-supply conductive wire is severed to electrically isolate the power supply from the transformer. Each of the at least one second lengths of the at least one power-supply conductive wire is severed to electrically isolate the transformer from the at least one screw-terminal-base connector. The electrically-isolated transformer is removed from the transformer housing. Each of the at least one severed first lengths of the at least one power-supply conductive wire is electrically coupled to a different one of the at least one severed second lengths of the at least one power-supply conductive wire. An Edison-base receptacle is mounted to the lamp housing, the Edison-base receptacle configured and arranged to receive a 120v lamp. Each of the at least one second lengths of the power-supply conductive wire is electrically coupled to the Edison-base receptacle.

In another embodiment, a composite lighting system includes a lighting assembly. The lighting assembly includes a transformer housing configured and arranged to receive at least a portion of a 120v to 12v transformer. A lamp housing is coupled to the transformer housing. The lamp housing is configured and arranged to receive a lamp with a diameter that is no greater than six inches. An Edison-base receptacle is disposed in the lamp housing. The Edison-base receptacle is configured and arranged to receive a 120v lamp. At least one power-supply conductive wire is configured and arranged to electrically couple the Edison-base receptacle to a power supply. Each of the at least one power-supply conductive wires includes a first length and a second length. At least one electrical splice connector is disposed in the transformer housing. Each of the at least one electrical splice connectors electrically couples together one of the at least one first lengths of the at least one power-supply conductive wires to a different one of the at least one second lengths of the at least one power-supply conductive wire.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

Figure 1A:
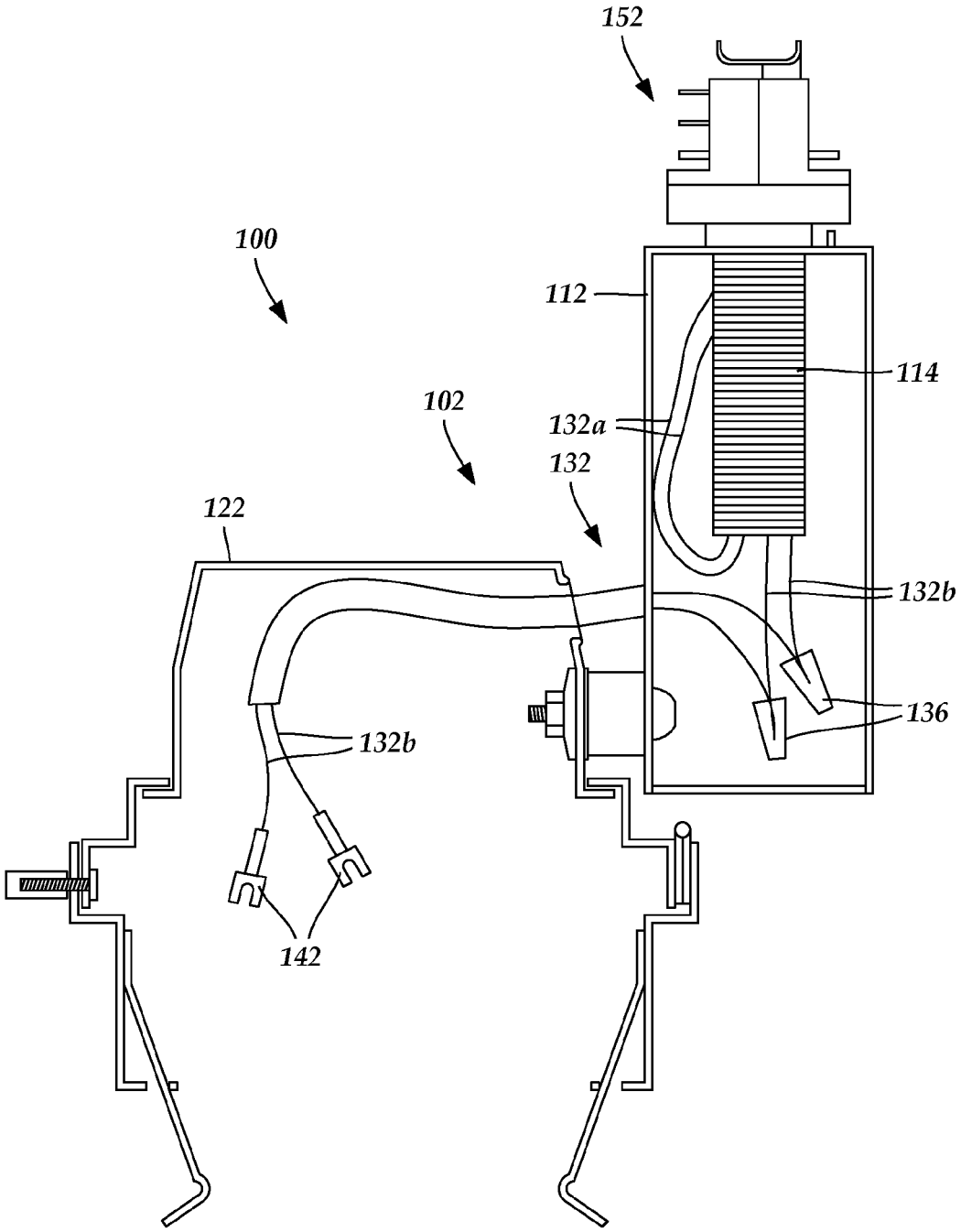
FIG. 1A is a schematic partial side view, partial cross-sectional view of one embodiment of an exemplary lighting assembly prior to retrofitting, the lighting assembly including a transformer disposed in a transformer housing and a screw-terminal-base connector disposed in a lamp housing, the screw-base connector configured for receiving a lamp with a screw terminal base.

The present invention is directed to the area of lighting systems and methods of making the lighting systems. The present invention is also directed to composite lighting systems retrofitted for receiving lamps with Edison bases, as well as methods of making the composite lighting systems.

Lighting systems, including lighting assemblies with lamp housings and lamps, are commonly used for illumination in residential and commercial settings, as well as for various types of transportation-related illumination. Some lighting systems use incandescent lamps. Conventional incandescent lamps, such as parabolic aluminized reflector ("PAR") lamps and halogen aluminum reflector ("AR") lamps, are currently widely-used for illumination in a variety of settings (e.g., museums, arenas, galleries, restaurants, offices, domiciles, libraries, commercial shops, or the like).

In at least some cases, lamps that include a plurality of light-emitting diodes ("LEDs") have been shown to be comparable in function to incandescent lamps, while being less expensive to operate. In facilities where many lighting systems are utilized, such as in museums, arenas, office buildings, and the like, replacing conventional incandescent lamps with LED lamps may add up to significant savings in money over time.

Unfortunately, at least some lighting systems that use incandescent lamps have lamp housings that are sized to be compatible with only a narrow range of lamp sizes. For example, the 12 volt 46 Series and LN 36 Series light fixtures (both manufactured by Lighting Services, Inc of Stony Point, N.Y.) are compatible only with PAR 36 and AR 111 lamps. Additionally, at least some lighting systems have screw-terminal-base connectors which include one or more connectors, such as spade connectors, to couple with a narrow range of lamp types. In some cases, LED lamps may not be currently manufactured in sizes or with bases that are compatible with some lighting systems configured for use with incandescent lamps. Moreover, at least some incandescent lighting systems are configured to receive electrical signals at 12 volts; whereas, at least some LED lamps are configured to receive electrical signals at 120 volts.

Thus, in at least some cases if someone were to desire to replace their conventional incandescent lamps with LED lamps, that person may need to replace their entire lighting system. The financial cost of replacing an entire lighting system may greatly reduce, or even completely offset any financial savings associated with switching from incandescent lamps to LED lamps.

Furthermore, since at least some lighting systems may only be compatible with very specific types of incandescent lamps, there may only be a limited number of illumination options. If adjustment to the light provided from those lamps is desired, the provided light may need to be passed through one or more illumination accessories disposed on (or in close proximity to) the lamp housing to alter one or more physical characteristics of the light provided by the lamp (e.g., distribution, color, softness, or the like). Such illumination accessories may include, for example, one or more louvers, color filters, UV filters, beam softeners, screens, lenses, beam spreaders, baffles, or the like.

Installing such illumination accessories can be expensive and time-consuming. Another potential advantage of using LED lamps over conventional incandescent lamps is that a variety of different LED lamps may be compatible with a single lighting assembly. In which case, different particular physical characteristics of the light may be obtainable in a single lighting assembly by replacing the type of LED lamps associated with that lighting assembly. In at least some instances, many different particular physical characteristics of the light may be obtainable without using any illumination accessories.

As herein described, a composite lighting system includes a lighting assembly that was originally configured and arranged to receive an incandescent lamp with a screw terminal base via a screw-terminal-base connector and that has been modified (e.g., retrofitted) to receive a lamp having an Edison base via an Edison-base receptacle. In at least some embodiments, the Edison-base receptacle is mounted to the lighting assembly. In at least some embodiments, modification of the lighting assembly also includes removal of a transformer.

Figure 1B:
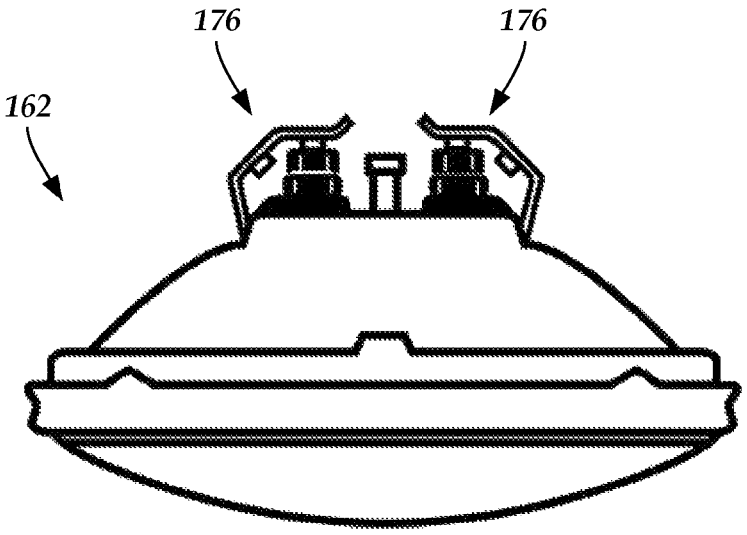
FIG. 1B is a schematic side view of one embodiment of a PAR lamp suitable for use with the exemplary lighting assembly of FIG. 1A.
Figure 1C:
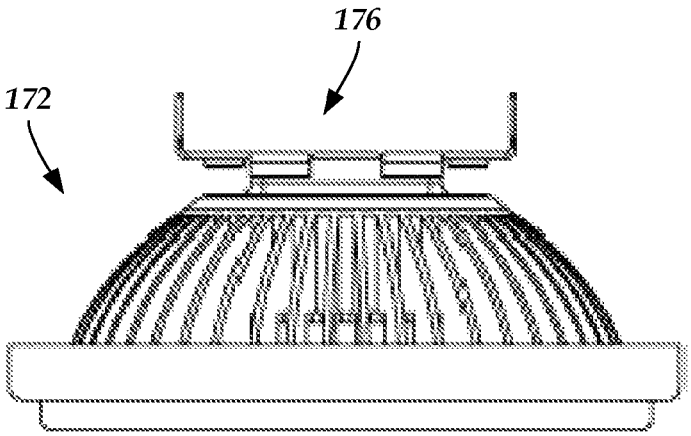
FIG. 1C is a schematic side view of one embodiment of an AR lamp suitable for use with the exemplary lighting assembly of FIG. 1A.

FIG. 1A is a schematic partial side view, partial cross-sectional side view of one embodiment of a lighting assembly 102 of a lighting system 100 prior to making any modifications. FIG. 1B is a schematic side view of one embodiment of a PAR lamp 162 suitable for use with the lighting assembly 102. FIG. 1C is a schematic side view of one embodiment of an AR lamp 172 suitable for use with the lighting assembly 102.

The lighting assembly 102 includes a transformer housing 112 and a lamp housing 122. In at least some embodiments, the lighting assembly 102 includes a mounting assembly 152 configured and arranged to mount the lighting assembly 102 to a structure (e.g., a wall, a ceiling, a pillar, a pipe, or the like). In at least some embodiments, the mounting assembly 152 may include one or more additional components for facilitating mounting of the lighting assembly 152 (e.g., a lighting track, or the like).

In FIG. 1A, the transformer housing 112 and the lamp housing 122 are shown in cross-section, while the remaining components are shown in side view. In at least some embodiments, the lighting system 100 includes other components including, for example, one or more power sources, one or more additional lighting assemblies, one or more lighting accessories (e.g., louvers, color filters, UV filters, beam softeners, screens, lenses, beam spreaders, baffles, or the like, and the like).

A transformer 114 may be disposed in the transformer housing 112. The transformer 114 may be any transformer 114 suitable for use with a lighting assembly. In at least some embodiments, the transformer 114 is a step-down transformer 114. In at least some embodiments, the transformer 114 is a 120v to 12v transformer.

The lamp housing 122 is configured and arranged for receiving an incandescent lamp with a screw terminal base 176, such as either of the lamps 162, 172. In at least some embodiments, when the lamp 162, 172 is inserted into the lamp housing 122 the lamp 162, 172 is electrically coupleable to a power supply (now shown) by one or more power-supply conductive wires 132. In at least some embodiments, one or more screw-terminal-base connectors 142 are coupled to the one or more power-supply conductive wires 132. In which case, the inserted lamp 162, 172 may be coupled directly to the one or more screw-terminal-base connectors 142 which, in turn, are coupled to the power supply. The screw-terminal-base connectors 142 may be implemented in any suitable manner to electrically couple to the screw terminal bases 176 of the lamps 162, 172. As shown in FIG. 1A, in at least some embodiments the screw-terminal-base connectors 142 are spade connectors.

In at least some embodiments, the one or more power-supply conductive wires 132 each include a first length 132*a* and a second length 132*b*. The first lengths 132*a* are coupled to the transformer 114 and extend therefrom towards the power supply (not shown). The second lengths 132*b* electrically couple the transformer 114 to the screw-terminal-base connectors 142. In at least some embodiments, the second lengths 132*b* of the power-supply conductive wires 132 include one or more electrical splice connectors (e.g., twist-on wire connectors, cone connectors, thimble connectors, or the like) 136. In at least some embodiments, when the second lengths 132*b* of the power-supply conductive wires 132 include one or more electrical splice connectors 136, the one or more electrical splice connectors 136 are disposed in the transformer housing 112.

The lamp housing 122 can have any suitable size and shape. In at least some embodiments, the lamp housing 122 is configured and arranged to receive a lamp with a round cross-sectional shape. In at least some embodiments, the lamp housing 122 is configured and arranged to receive a lamp having a round cross-sectional shape and a diameter that is no greater than six inches, five inches, or four-and-a-half inches. In at least some embodiments, the lamp housing 122 is configured and arranged to receive one of a PAR 26 lamp or an AR-111 lamp.

As shown in FIG. 1B and FIG. 1C, the PAR lamp 162 and the AR lamp 172 each include screw terminal bases 176 configured and arranged for coupling with screw-terminal-base connectors (142 in FIG. 1A). The PAR lamp 162 and the AR lamp 172 typically are configured and arranged to receive a power at a particular voltage when coupled to the lighting assembly 102. For example, in embodiments where the lighting assembly 102 includes a 120v to 12v transformer 114, the PAR lamp 162 and the AR lamp 172 are 12v lamps.

Figure 2:
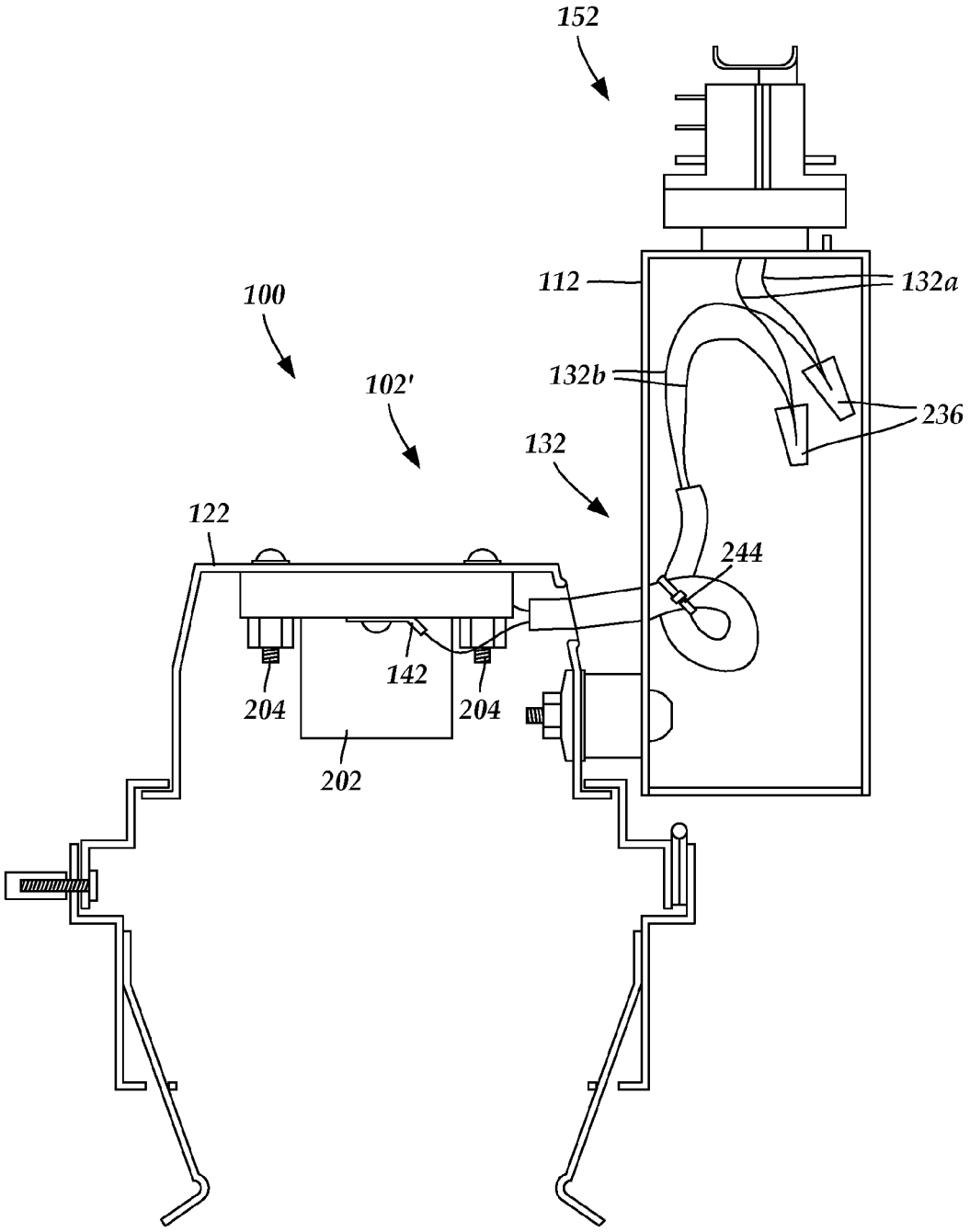
FIG. 2 is a schematic partial side view, partial cross-sectional view of one embodiment of the lighting assembly of FIG. 1A after removal of the transformer of FIG. 1A, and after an Edison-base receptacle has been mounted to the lamp housing of FIG. 1A and coupled to the screw-terminal-base connector of FIG. 1A, according to the invention.

Turning to FIG. 2, in at least some embodiments the lighting assembly is modified to use electricity directly from a power outlet without stepping down the voltage of the electricity. In which case, in at least some embodiments the lighting assembly may be modified to receive, for example, 120v lamps. Accordingly, in at least some embodiments the lighting assembly is modified to remove the transformer. In at least some embodiments, the lighting assembly is modified to enable lamps with Edison bases to couple with the lighting assembly. In at least some embodiments, the lighting assembly is modified to mount an Edison-base receptacle to the lamp housing.

FIG. 2 is a schematic partial side view, partial cross-sectional side view of one embodiment of a composite lighting assembly 102'. The composite lighting assembly 102' includes the lighting assembly 102 after undergoing modification (e.g., after being retrofitted). In FIG. 2, the transformer housing 112 and the lamp housing 122 are shown in cross-section, while the remaining components are shown in side view.

As shown in FIG. 2, the composite lighting assembly 102 includes an Edison-base receptacle 202 disposed in the lamp housing 122. In at least some embodiments, the Edison-base receptacle 202 is mounted to the lamp housing 122. The Edison-base receptacle 202 can be mounted in any suitable way to the lamp housing 122. In FIG. 2, the Edison-base receptacle 202 is shown mounted to the lamp housing 122 by one or more fasteners, such as fasteners 204. Any suitable fasteners 204 may be used including, for example, screws, bolts, pins, staples, adhesive, or the like or combinations thereof.

The Edison-base receptacle 202 is electrically coupled to the power-supply conductive wire 132. In at least some embodiments where the one or more screw-terminal-base connectors 142 are electrically coupled to the power-supply conductive wire 132, the one or more screw-terminal-base connectors 142 are electrically coupled directly to the Edison-base receptacle 202.

In FIG. 2, the transformer (114 in FIG. 1A) has been removed from the transformer housing 112 so that 120v electrical signals are provided to the Edison-base receptacle 202 from the power supply (not shown). The transformer may be removed in any suitable manner. In at least some embodiments, the transformer is removed by severing the first length 132*a* and the second length 132*b* of the conductive wire 132. In which case, the severed ends of the first length 132*a* and the second length 132*b* may be spliced together to re-establish electrical contact between the Edison base 202 and the power supply. In at least some embodiments, when the first length 132*a* and the second length 132*b* are spliced together, one or more electrical splice connectors 236 (e.g., twist-on wire connectors, cone connectors, thimble connectors, or the like) may be used to facilitate maintaining an electrical connection between the severed end of the first length 132*a* and the severed end of the second length 132*b* of the conductive wire 132.

In at least some embodiments, one or more strain reliefs 244 may disposed around a portion of the first length 132*a* of the conductive wire 132. The one or more strain reliefs 244 may be used to control the amount of the second length 132*b* of the conductive wire 132 extending between the transformer housing 112 and the lamp housing 122. The one or more strain reliefs 244 may be formed in any suitable manner (e.g., zip ties, or the like).

Figure 3A:
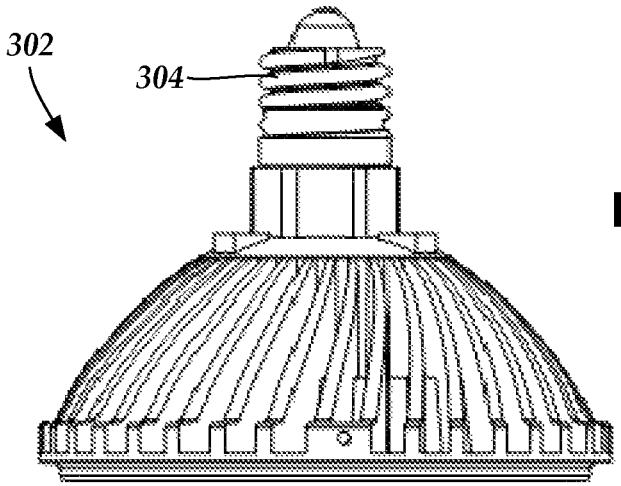
FIG. 3A is a schematic side view of one embodiment of a lamp suitable for use with the lighting assembly of FIG. 2, the lamp including an Edison base suitable for insertion into, and electrical coupling with, the Edison-base receptacle of FIG. 2.

Turning to FIG. 3A, it may be an advantage to enable lamps with Edison bases to couple to the lighting system. A larger variety of different types of lamps may be available with Edison bases than with screw terminal bases including, for example, lamps with a plurality of light-emitting diodes disposed thereon, and lamps with different colors, beam patterns, filters, and the like.

Figure 3B:
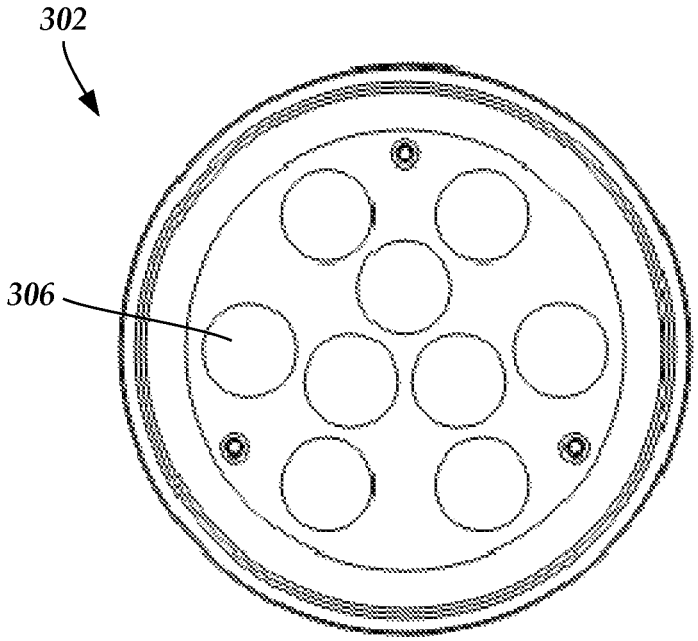
FIG. 3B is a schematic top view of one embodiment of the lamp of FIG. 3A, the lamp including a plurality of light-emitting diodes.

FIG. 3A is a schematic side view of one exemplary embodiment of a lamp 302 suitable for use with the lighting assembly 102'. FIG. 3B is a schematic top view of one embodiment of the lamp 302. The lamp 302 includes an Edison base 304 suitable for insertion into, and electrical coupling with, the Edison-base receptacle (202 in FIG. 2). The lamp 302 can be any type of lamp 302 with an Edison base 304 suitable for use with the lighting assembly 102'. In at least some embodiments, the lamp 302 includes a plurality of light-emitting diodes, such as light-emitting diode 306.

Figure 4:
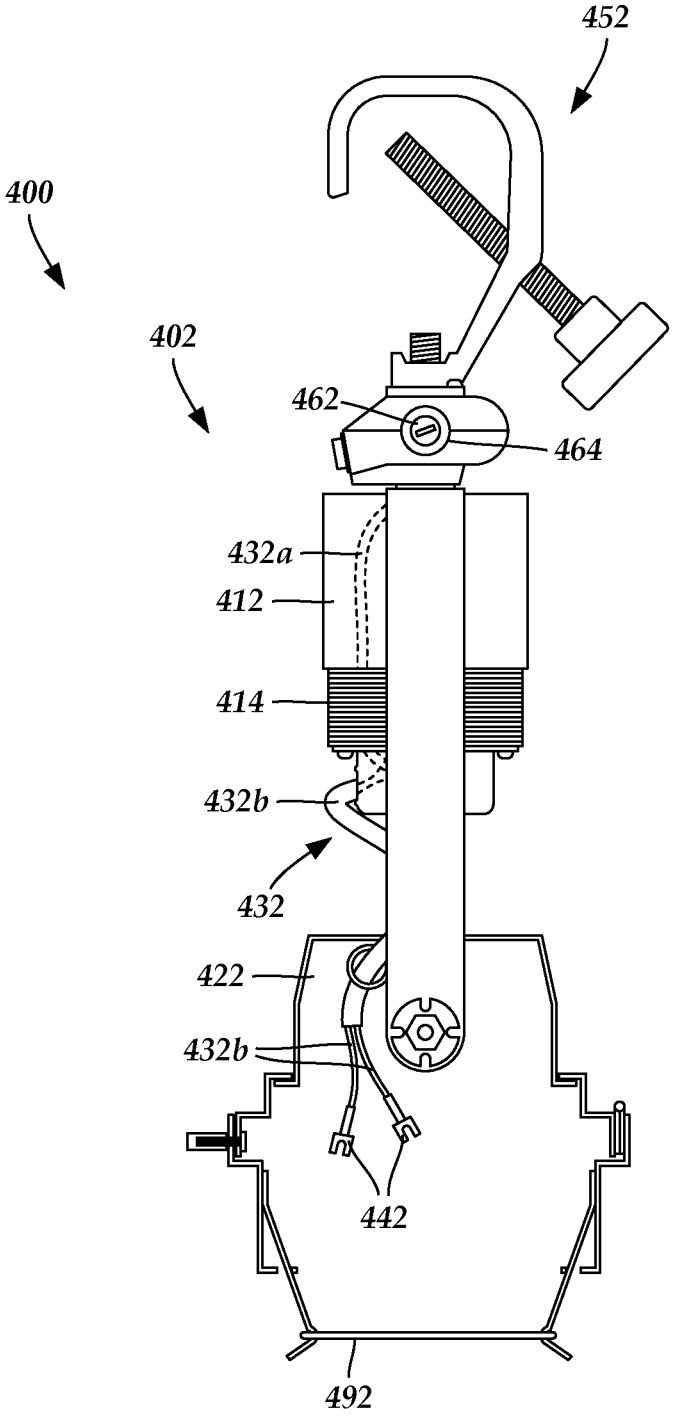
FIG. 4 is a schematic partial side view, partial cross-sectional view of another embodiment of an exemplary lighting assembly prior to making any modifications, the lighting assembly having a screw-terminal-base connector disposed in a lamp housing, as well as a transformer and a fuse.

Turning to FIG. 4, the lighting system may include any suitable lighting assembly that was originally configured and arranged to receive an incandescent lamp with a screw terminal base via a screw-terminal-base connector and that can be modified to receive a lamp having an Edison base, via an Edison-base receptacle. In at least some embodiments, the lighting assembly includes a transformer that is removed during a modification of the lighting assembly. In at least some embodiments, the lighting assembly includes one or more fuses that are removed during a modification of the lighting assembly. In at least some embodiments, the lighting assembly includes one or more illumination accessories (e.g., louvers, color filters, UV filters, beam softeners, screens, lenses, beam spreaders, baffles, or the like, and the like).

FIG. 4 is a schematic partial side view, partial cross-sectional side view of another embodiment of a lighting assembly 402 for a lighting system 400. The lighting assembly 402 includes a transformer housing 412 and a lamp housing 422. In FIG. 4, the lamp housing 422 is shown in side cross-sectional view, while the remaining features of the lighting assembly 402 are shown in side view.

The lamp housing 422 is configured and arranged for receiving an incandescent lamp with a screw terminal base (see e.g., 176 in FIGS. 1B-1C), such as either of the lamps (see e.g., 162 and 172 in FIGS. 1B-1C). In at least some embodiments, when the lamp 162, 172 is inserted into the lamp housing 122 the lamp 162, 172 is electrically coupleable to a power supply (now shown) by one or more power-supply conductive wires 432. In at least some embodiments, one or more screw-terminal-base connectors 442 are coupled to the one or more power-supply conductive wires 432. In which case, the inserted lamp 162, 172 may be coupled directly to the one or more screw-terminal-base connectors 442 which, in turn, are coupled to the power supply. As shown in FIG. 4, in at least some embodiments the screw-terminal-base connectors 442 are spade connectors.

In at least some embodiments, the lighting assembly 402 includes a mounting assembly 452 configured and arranged to mount the lighting assembly 402 to a structure (e.g., a wall, a ceiling, one or more pipes, a pillar, or the like). In at least some embodiments, the lighting assembly 402 further includes one or more fuses 462 disposed in a fuse housing 464. The one or more fuses 462 are electrically coupled to the one or more power-supply conductive wires 432.

In at least some embodiments, the lighting system 100 further includes one or more illumination accessories (e.g., louvers, color filters, UV filters, beam softeners, screens, lenses, baffles, or the like) 492 to alter one or more physical characteristics of the light provided by the lamp (e.g., distribution, color, softness, or the like). In FIG. 4, the illumination accessory 492 is shown coupled to the lamp housing 422. In alternate embodiments, the illumination accessory 492 is a stand-alone component that is not physically coupled to the lamp housing 422.

In at least some embodiments, the lighting assembly 402 includes a transformer 414 disposed in the transformer housing 412. In FIG. 4, the transformer 414 is shown partially exposed from the transformer housing 412, such that at least a portion of the transformer 414 is visible from outside of the transformer housing 412. In at least some embodiments, the one or more power-supply conductive wires 432 each include a first length 432*a* and a second length 432*b*. The first lengths 432*a* are coupled to the transformer 414 and extend therefrom towards the power supply (not shown). The second lengths 432*b* electrically couple the transformer 414 to the screw-terminal-base connectors 442.

Figure 5:
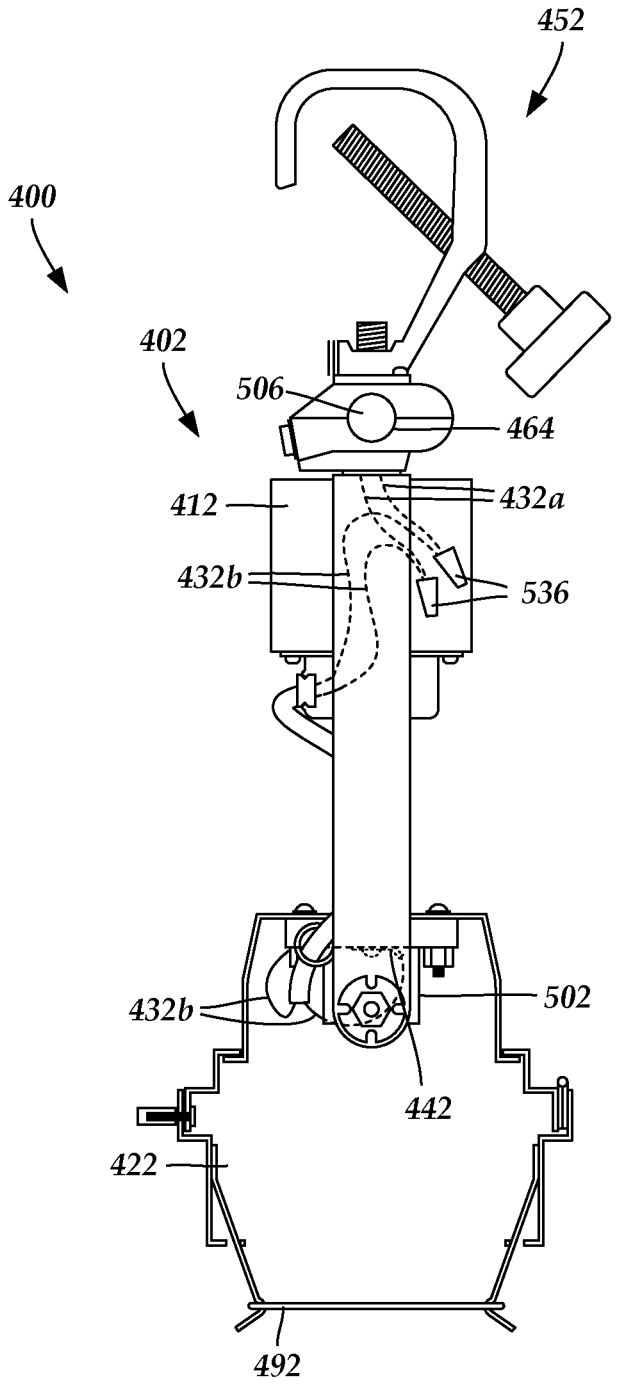
FIG. 5 is a schematic partial side view, partial cross-sectional view of one embodiment of the lighting assembly of FIG. 4 after removal of the transformer of FIG. 4 and the fuse of FIG. 4, and after an Edison-base receptacle has been mounted to the lamp housing of FIG. 4 and coupled to the screw-terminal-base connector of FIG. 4, according to the invention.

FIG. 5 is a schematic partial side view, partial cross-sectional side view of one embodiment of a composite lighting assembly 402'. The composite lighting assembly 402' includes the lighting assembly 402 after undergoing modification (e.g., after being retrofitted). The composite lighting assembly 402' includes the transformer housing 412 and the lamp housing 422. In FIG. 5, the lamp housing 422 is shown in side cross-sectional view, while the remaining features of the lighting assembly 402' are shown in side view.

As shown in FIG. 5, the composite lighting assembly 402 includes an Edison-base receptacle 502 disposed in the lamp housing 422. The Edison-base receptacle 502 is electrically coupled to the power-supply conductive wire 532 via the one or more screw-terminal-base connectors 442.

In FIG. 5, the transformer (414 in FIG. 4) has been removed from the transformer housing 422 and the severed ends of the first length 432*a* and the second length 432*b* are spliced together to re-establish an electrical connection between the Edison base 502 and the power supply. One or more electrical splice connectors 536 (e.g., twist-on wire connectors, cone connectors, thimble connectors, or the like) are disposed between the severed end of the first length 432*a* and the severed end of the second length 432*b* to facilitate maintaining an electrical connection along the power-supply conductive wire 432. In FIG. 5, a cover plug 506 is shown disposed over the fuse housing 464.

Figure 6:
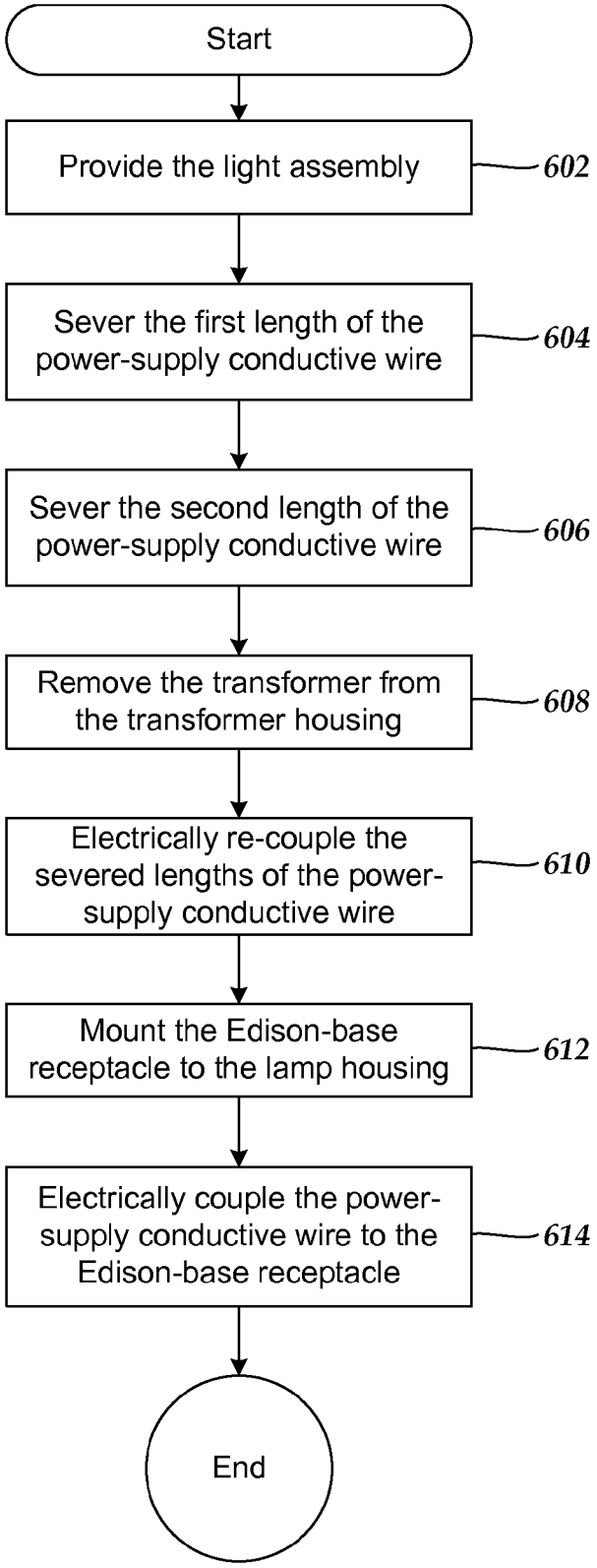
FIG. 6 is a control-flow diagram illustrating one embodiment of a method for retrofitting a lighting assembly, according to the invention.

The lighting assemblies may be modified in any suitable way to receive a lamp having an Edison base via an Edison-base receptacle. FIG. 6 is a control-flow diagram illustrating one exemplary embodiment of a method for retrofitting a lighting system. In step 602, the lighting assembly 102/402 is provided. In step 604, the first length 132*a*/432*a* of the power-supply conductive wire 132/432 is severed. In step 606, the second length 132*b*/432*b* of the power-supply conductive wire 132/432 is severed. In step 608, the transformer 114/414 is removed from the transformer housing 112/412. In step 610, the severed first length 132*a*/432*a* of the power-supply conductive wire 132/432 and the severed second length 132*b*/432*b* of the power-supply conductive wire 132/432 are electrically coupled together. In step 612, the Edison-base receptacle 202/502 is mounted to the lamp housing 122/422. In step 614, the power-supply conductive wire 132/432 is electrically coupled to the Edison-base receptacle 202/502. It will be understood that any of the above steps can be performed manually or by way of an automated system.

The above specification, examples and data provide a description of the manufacture and use of the composition of the invention. Since many embodiments of the invention can be made without departing from the spirit and scope of the invention, the invention also resides in the claims hereinafter appended.

What is claimed as new and desired to be protected by Letters Patent of the United States is:

1. A method for retrofitting a lighting system, the method comprising:

providing a lighting assembly, the lighting assembly comprising a 120v to 12v transformer disposed at least partially in a transformer housing, a lamp housing coupled to the transformer housing, the lamp housing configured and arranged to receive a lamp with a diameter that is no greater than six inches, at least one screw-terminal-base connector disposed in the lamp housing, the at least one screw-terminal-base connector configured and arranged to receive a 12v lamp, and at least one power-supply conductive wire, each of the at least one power-supply conductive wires comprising a first length and a second length, wherein each of the at least one first lengths is coupled at one end to the transformer while an opposing end of each of the at least one first lengths is coupleable to a power supply, and wherein each of the at least one second lengths is coupled at one end to the transformer while an opposing end of each of the at least one second lengths is coupled to the at least one screw-terminal-base connector;

severing each of the at least one first lengths of the at least one power-supply conductive wire to electrically isolate the power supply from the transformer;

severing each of the at least one second lengths of the at least one power-supply conductive wire to electrically isolate the transformer from the at least one screw-terminal-base connector;

removing the electrically-isolated transformer from the transformer housing;

electrically coupling each of the at least one severed first lengths of the at least one power-supply conductive wire to a different one of the at least one severed second lengths of the at least one power-supply conductive wire;

mounting an Edison-base receptacle to the lamp housing, the Edison-base receptacle configured and arranged to receive a 120v lamp; and electrically coupling each of the at least one second lengths of the power-supply conductive wire to the Edison-base receptacle.

2. The method of claim 1, wherein electrically coupling each of the at least one second lengths of the power-supply conductive wire to the Edison-base receptacle comprises electrically coupling each of the at least one second lengths of the power-supply conductive wire to the Edison-base receptacle via the at least one screw-terminal-base connector.

3. The method of claim 2, wherein each of the at least one screw-terminal-base connector comprises a different spade connector.

4. The method of claim 1, further comprising electrically coupling a lamp to the Edison-base receptacle.

5. The method of claim 4, wherein electrically coupling the lamp to the Edison-base receptacle comprises electrically coupling the lamp to the Edison-base receptacle, wherein the lamp comprises a plurality of light-emitting diodes.

6. The method of claim 4, wherein electrically coupling the lamp to the Edison-base receptacle comprises electrically coupling the lamp to the Edison-base receptacle, wherein the lamp is an incandescent reflecting lamp.

7. The method of claim 4, wherein electrically coupling the lamp to the Edison-base receptacle comprises electrically coupling the lamp to the Edison-base receptacle, wherein the lamp has a diameter that is no greater than four-and-a-half inches.

8. The method of claim 1, further comprising removing at least one fuse electrically coupled to the at least one power-supply conductive wire.

9. The method of claim 1, further comprising adding a strain relief to a portion of each of the at least one power-supply conductive wires.

10. A composite lighting system comprising:

a lighting assembly comprising a transformer housing configured and arranged to receive at least a portion of a 120v to 12v transformer;

a lamp housing coupled to the transformer housing, the lamp housing configured and arranged to receive a lamp with a diameter that is no greater than six inches;

an Edison-base receptacle disposed in the lamp housing, the Edison-base receptacle configured and arranged to receive a 120v lamp; and at least one power-supply conductive wire configured and arranged to electrically couple the Edison-base receptacle to a power supply, each of the at least one power-supply conductive wire comprising a first length and a second length; and at least one electrical splice connector disposed in the transformer housing, each of the at least one electrical splice connectors electrically coupling together one of the at least one first lengths of the at least one power-supply conductive wires to a different one of the at least one second lengths of the at least one power-supply conductive wire.

11. The lighting system of claim 10, wherein the lamp housing is configured and arranged to receive a lamp having a diameter that is no greater than four-and-a-half inches.

12. The lighting system of claim 10, wherein the lamp housing is configured and arranged for receiving an incandescent reflecting lamp.

13. The lighting system of claim 10, wherein the lamp housing is configured and arranged for receiving one of a parabolic aluminized reflecting 36 lamp or a halogen aluminum reflecting 111 lamp.

14. The lighting system of claim 10, further comprising at least one fuse electrically coupled to the at least one power-supply conductive wire.

15. The lighting system of claim 10, further comprising a strain relief disposed along each of the at least one power-supply conductive wires.

16. The lighting system of claim 10, further comprising a lamp with an Edison base, the lamp configured and arranged to screw into the Edison-base receptacle.

17. The lighting system of claim 16, wherein the lamp comprises a plurality of light-emitting diodes.

18. The lighting system of claim 16, wherein the lamp is one of a PAR 30 lamp or a PAR 20 lamp.

19. The lighting system of claim 10, wherein the lighting assembly comprises a mounting assembly coupled to the transformer housing, the mounting assembly configured and arranged to mount the lighting system to at least one of a wall or a ceiling.

20. The lighting system of claim 10, further comprising at least one illumination accessory.

* * * * *